US007350890B2

(12) United States Patent
Baird et al.

(10) Patent No.: US 7,350,890 B2
(45) Date of Patent: Apr. 1, 2008

(54) APPARATUS AND METHODS FOR APPLYING IMAGES TO A SURFACE

(75) Inventors: Richard W. Baird, Kent, WA (US); Glenn R. Dalby, Shoreline, WA (US); William J. Postl, Granite Falls, WA (US)

(73) Assignee: The Boeing Company, Chicago, IL (US)

( * ) Notice: Subject to any disclaimer, the term of this patent is extended or adjusted under 35 U.S.C. 154(b) by 474 days.

(21) Appl. No.: 10/926,801

(22) Filed: Aug. 26, 2004

(65) Prior Publication Data

US 2006/0044376 A1 Mar. 2, 2006

(51) Int. Cl.
*B41J 25/308* (2006.01)

(52) U.S. Cl. ..... 347/8; 347/2

(58) Field of Classification Search ..... 347/102, 347/8, 40–44, 2

See application file for complete search history.

(56) References Cited

U.S. PATENT DOCUMENTS

| | | | | |
|---|---|---|---|---|
| 4,435,719 | A * | 3/1984 | Snaper | 347/82 |
| 4,864,966 | A | 9/1989 | Anderson et al. | |
| 4,900,371 | A | 2/1990 | Dexter et al. | |
| 4,920,422 | A * | 4/1990 | Lapierre | 358/296 |
| 5,061,331 | A | 10/1991 | Gute | |
| 5,328,540 | A | 7/1994 | Clayton et al. | |
| 5,397,415 | A | 3/1995 | Manabe et al. | |
| 5,844,584 | A * | 12/1998 | Murphy et al. | 347/20 |
| 5,975,679 | A | 11/1999 | Nicoloff, Jr. et al. | |
| 6,126,282 | A | 10/2000 | Oikawa | |
| 6,450,605 | B1 | 9/2002 | Walmsley et al. | |
| 6,523,921 | B2 * | 2/2003 | Codos | 347/8 |
| 2003/0007023 | A1 | 1/2003 | Barclay et al. | |
| 2003/0020773 | A1 * | 1/2003 | Scahntz et al. | 347/14 |

FOREIGN PATENT DOCUMENTS

| | | |
|---|---|---|
| DE | 19634582 A1 | 3/1998 |
| FR | 2601265 | 1/1988 |
| FR | 2862563 A1 | 5/2005 |
| JP | 1133800 | 5/1989 |

* cited by examiner

*Primary Examiner*—Julian D. Huffman
*Assistant Examiner*—Jason Uhlenhake
(74) *Attorney, Agent, or Firm*—Lee & Hayes, PLLC

(57) ABSTRACT

Systems and methods for applying graphic images to a surface are disclosed. In an embodiment, a system includes an applicator to direct a droplet pattern of a pigmented ink towards the surface, an motivating device coupled to the applicator to move the applicator in at least one transverse direction relative to the surface and also in a direction perpendicular to the surface, and a controller coupled to the motivating device that is configured to receive data corresponding to the graphics image and to control at least the motion of the motivating device to apply the graphic image to the surface. In another aspect, a method includes receiving an image file from an image source and generating a surface model that describes geometrical contours of the surface. An applicator is then controlled according to the surface model, and the graphic image is applied that corresponds to the image file.

17 Claims, 6 Drawing Sheets

APPARATUS AND METHODS FOR APPLYING IMAGES TO A SURFACE

FIELD OF THE INVENTION

This invention relates generally to the application of graphic images, and, more specifically, to systems and methods for applying graphic images to a surface.

BACKGROUND OF THE INVENTION

In various commercial products, it is desirable to impart colorful visual effects through the application of a pigmented formulation to a surface to form an aesthetically appealing image. The image may be applied to the surface by various methods, including applying a paint material to the surface by means of a brush or an aerosol spray. Alternately, other methods may be used that avoid painting processes altogether. For example, an appliquéor a decal having the desired image formed thereon may be adhered to the surface.

The foregoing conventional methods have been widely used to apply images to an exterior portion of an aircraft. For example, images may be applied to wing, fuselage and tail surfaces of the aircraft for decorative and/or functional purposes. Since the images are typically large and often detailed, skilled personnel are required to paint or adhere an image to an exterior portion of the aircraft. Consequently, the production cost of an aircraft is increased due to the additional labor cost associated with painting or adhering an image to the exterior portion of the aircraft.

Other shortcomings stem from the foregoing processes, which will now be described in detail. FIG. 1 is a partial cross-sectional view of an external portion 10 of an aircraft having a painted image applied thereon, according to the prior art. The external portion 10 includes a supporting surface 12, which is typically a structural portion of the aircraft, such as a fuselage panel, a wing panel, or other external surfaces of the aircraft, and a plurality of paint layers 14 that are applied to the supporting surface 12. The paint layers 14 may include a primer layer 16, a base color layer 18, and a plurality of decorative color layers 20 that collectively form the painted image on the external portion 10.

One significant shortcoming present in this method is that the paint layers 14 are generally successively applied to the supporting surface 12, so that a time-consuming drying period is required between successive paint applications, thus increasing the production time for the aircraft. Further, the application of the decorative color layers 20 additionally requires the application of paint masking devices such as stencils, or tape between successive applications of the layers 20, which requires still more time and labor. Since spray application devices may only apply a single color portion of the image, the spray application device must be cleaned numerous times before image is complete, thus requiring still more time and labor.

Still other shortcomings are inherent in the image itself when the image is applied by the foregoing method. For example, the application of the decorative color layers 20 generally results in an external surface 22 having surface irregularities 24. Since the external surface 22 is exposed to a slipstream while the aircraft is in flight, the surface irregularities 24 generate additional surface drag on the aircraft that results in increased fuel consumption for the aircraft. Although appliqués, such as decals and other similar preformed images have been widely used for applying images to aircraft, and generally present a smooth external surface to the slipstream, appliqués are susceptible to premature degradation through prolonged exposure to ultraviolet radiation that results in fading and/or discoloration of the image. In addition, appliqués may partially detach from the aircraft surface, particularly along exposed edges of the appliqúe, so that maintenance costs for the aircraft are increased.

Therefore, there is an unmet need in the art for systems and methods for forming an image on an aircraft exterior that results in lower production and maintenance costs, while providing an image that is generally superior to those currently produced.

SUMMARY OF THE INVENTION

The present invention discloses systems and methods for applying graphic images to a surface. In one aspect, a system includes an applicator to direct a droplet pattern of a pigmented ink towards the surface, an motivating device coupled to the applicator to move the applicator in at least one transverse direction relative to the surface and also in a direction perpendicular to the surface, and a controller coupled to the motivating device that is configured to receive data corresponding to the graphics image and to control at least the motion of the motivating device to apply the graphic image to the surface. In another aspect, a method includes receiving an image file from an image source and generating a surface model that describes geometrical contours of the surface. An applicator is then controlled according to the surface model, and the graphic image is applied that corresponds to the image file.

BRIEF DESCRIPTION OF THE DRAWINGS

The preferred and alternative embodiments of the present invention are described in detail below with reference to the following drawings.

DETAILED DESCRIPTION OF THE INVENTION

The present invention relates to the application of images to a surface and, more specifically, to systems and methods for applying decorative images to an aircraft surface. Many specific details of certain embodiments of the invention are set forth in the following description and in FIGS. 2 through 8 to provide a thorough understanding of such embodiments. One skilled in the art, however, will understand that the present invention may have additional embodiments, or that the present invention may be practiced without several of the details described in the following description.

Figure 1:
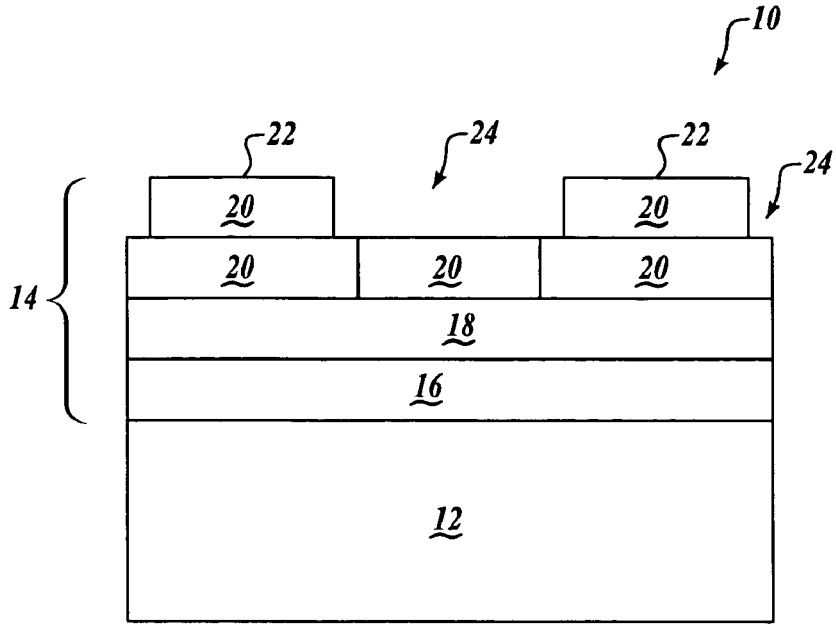
FIG.1 (PRIOR ART)
FIG. 1 is a partial cross-sectional view of an external portion of an aircraft having a painted image applied thereon, according to the prior art.
Figure 2:
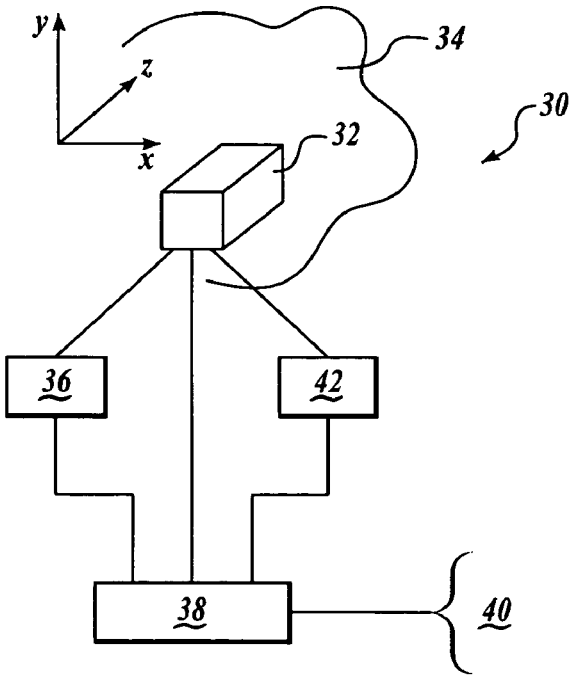
FIG. 2 is a block diagrammatic view of a system for applying a graphic image to a surface according to an embodiment of the invention.

FIG. 2 is a block diagrammatic view of a system 30 for applying a graphic image to a surface according to an embodiment of the invention. The system 30 includes an applicator 32 operable to apply pigmented formulations such as inks of various colors to a surface 34. The applicator 32 will be described in greater detail below. The applicator 32 is coupled to an actuator (or other suitable motivating device) 36 that is configured to move the applicator 32 in a transverse direction relative to the surface 34 by moving the applicator 32 in an x-direction and a y-direction. The actuator 36 may also move the applicator 32 in a perpendicular direction relative to the surface 34 by moving the applicator 32 in a z-direction. The actuator 36 may comprise any positioning device operable to receive positioning instructions and configured to position the applicator 32 in the instructed position. In one specific embodiment, the actuator is a programmable manipulator such as robotic device capable of at least three-axis motion. In another embodiment, the actuator 36 comprises a three-axis translational device that will also be described in further detail below. The actuator 36 is coupled to a controller 38 operable to receive image information 40 and control the motion of the actuator 36. The controller 38 is also operable to control an applicator supply system 42 that supplies a liquid pigmented material to the applicator 32. The applicator supply system 42 will be described in further detail below. The controller 38 is further coupled to the applicator 32 in order to control the operation of the applicator 32, as will also be described in detail below.

Figure 3:
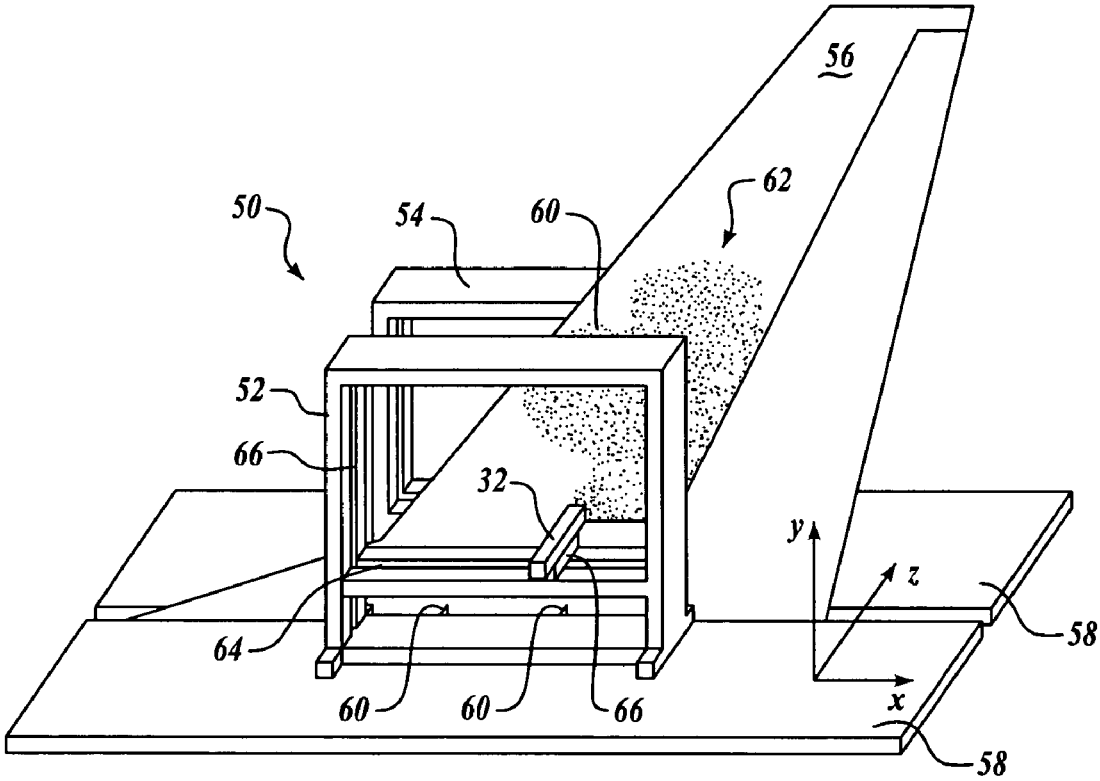
FIG. 3 is an isometric view of an actuator according to another embodiment of the invention, which may be used with the system of FIG. 2.

FIG. 3 is an isometric view of an actuator 50 according to another embodiment of the invention, which may be used with the system 30 of FIG. 2. The actuator 50 includes a first frame 52 and a second frame 54 that is coupled to the first frame 52 to form a rigid unitary structure. The first frame 52 is spaced apart from the second frame 54 to permit a fin portion 56 of an aircraft enpennage to be interposed between the first frame 52 and the second frame 54. The actuator 50 is further configured to rest on a support platform 58 adjacent to the fin portion 56. In this embodiment, the actuator 50 also includes vacuum retainers 60 configured to retain the actuator 50 in a fixed position relative to the fin portion 56. In particular, the vacuum retainers 60 are configured to hold the actuator 50 in proper registration with an image 62 formed on the fin portion 56 by the applicator 32. The vacuum retainers 60 form an enclosed volume when the retainers 60 are moved into a sealable relationship with the fin portion 56, which is evacuated by a vacuum pump (not shown in FIG. 3) in order to restrain relative movement between the actuator 50 and the fin portion 56.

The first frame 52 and the second frame 54 have a first guide 64 that guides the applicator 32 in the x-direction as it is moved. The first frame 52 and the second frame 54 also include a second guide 66 to guide the applicator 32 in the y-direction as it is moved. Accordingly, the first guide 64 and the second guide 66 also include translation devices (not shown in FIG. 3) operable to move the applicator 32 along the first guide 64 and the second guide 66. For example, the translation devices may include a ball-bearing screw translation device, as is well understood in the art, although other linear translation devices are available. The first frame 52 and the second frame 54 also include a linear translator 66 operable to move the applicator 32 in the z-direction. The linear translator 66 may also include a ball-bearing screw translation device, although other linear translation devices may be used.

Although the actuator 50 shown in FIG. 3 is configured to apply the image 62 on opposing sides of the aircraft fin 56, it is understood that, in other embodiments, the actuator 50 may include a single applicator 32 positioned on one of the first frame 52 and the second frame 54. Moreover, the actuator 50 of FIG. 3 includes a substantially linear first guide 64 and a substantially linear second guide 66. In other embodiments, the first guide 64 and/or the second guide 66 may be curved to conform to other structural shapes. For example, the second linear guide 66 may have a substantially curved shape while the first guide 64 is linear, so that the actuator 50 may be used to apply an image to a curved structural portion, such as a portion of an aircraft fuselage.

Figure 4:
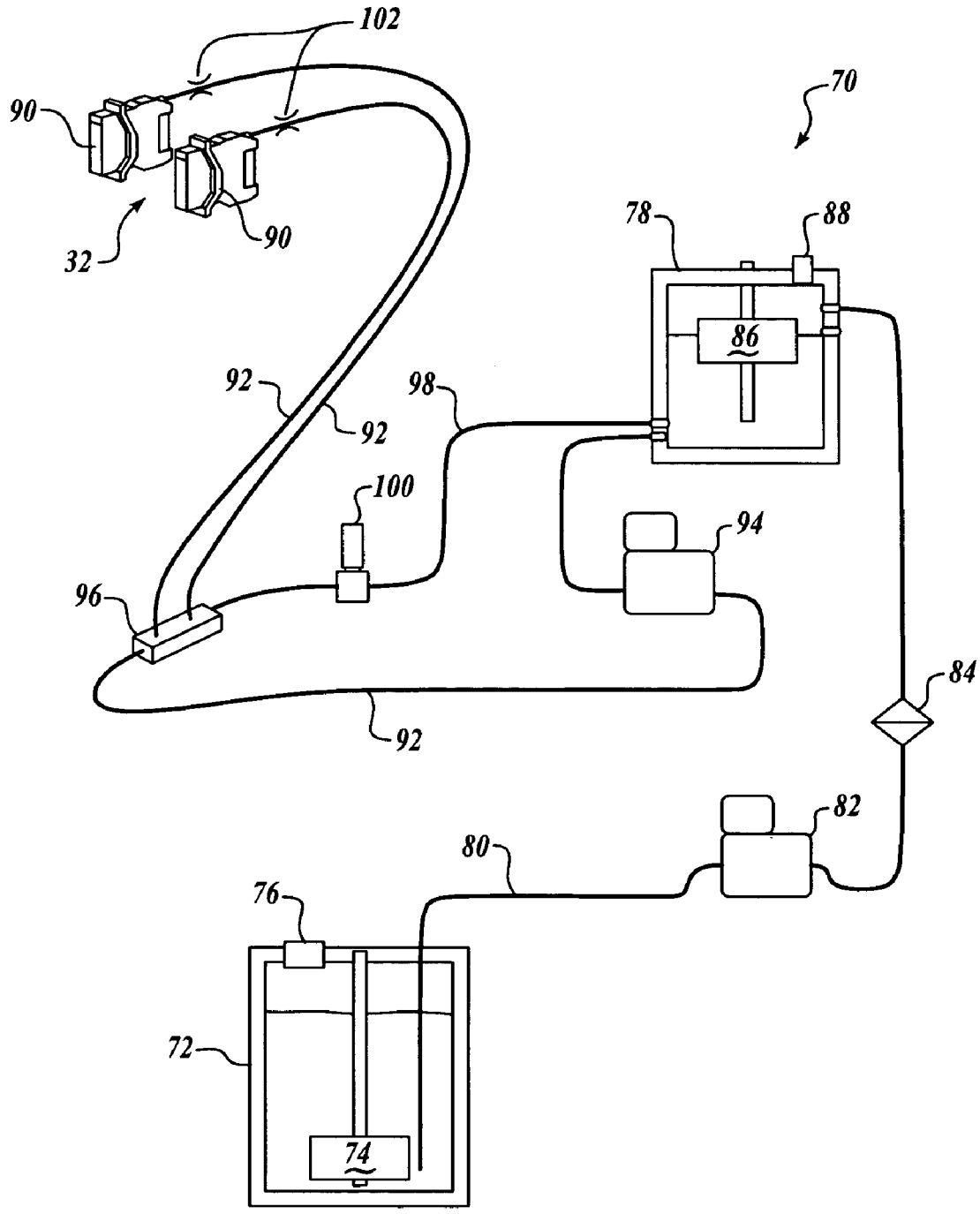
FIG. 4 is a schematic view of an applicator supply system according to still another embodiment of the invention that may be used with the system of FIG. 2.

FIG. 4 is a schematic view of an applicator supply system 70 according to still another embodiment of the invention that may be used with the system 30 of FIG. 2. The applicator supply system 70 includes a bulk supply reservoir 72 that contains a volume of a pigmented formulation, such as ink, or other similar materials. The bulk supply reservoir 72 includes a level sensor 74 that is operable to sense a liquid level within the bulk supply reservoir 72 and generate a signal when the liquid level falls below a predetermined level. The bulk supply reservoir 72 also includes a fill port 76 to permit the pigmented formulation to be replenished. The fill port 76 may also be configured with an atmospheric vent to equalize a pressure within the bulk supply reservoir 72 with an atmospheric pressure. The bulk supply reservoir 72 is coupled to a feeder reservoir 78 by a supply line 80. Since the bulk supply reservoir 72 and the feeder reservoir 78 may be positioned at different relative elevations, a supply pump 82 is positioned in the supply line 80 to move the pigmented material from the bulk supply reservoir 72 to the feeder reservoir 78. The supply line 80 may also include a filter 84 to remove foreign material or agglomerated pigments from the material in the bulk supply reservoir 72. The feeder reservoir 78 also includes a level sensor 86 that is operable to sense a liquid level within the feeder reservoir 78 and generate a signal when the liquid level falls below a predetermined level. An atmospheric vent 88 is positioned on the feeder reservoir 78 to equalize an internal pressure within the feeder reservoir 78 with an atmospheric pressure.

The feeder reservoir 78 is coupled to the applicator 32 (as shown in FIG. 2) having at least one applicator head 90 by distribution lines 92. The applicator head 90 will be discussed in greater detail below. An applicator pump 94 moves a liquid stored within the feeder reservoir 78 to the applicator 32, and further provides a pressure that is sufficient to atomize the liquid that is supplied to the at least one applicator head 90. A distribution manifold may be positioned in the distribution lines 92 to permit more than a single applicator head 90 to be supplied. The distribution manifold 96 may also be coupled to a return line 98 that permits liquid to return to the reservoir 78, thus avoiding excessive liquid pressures at the at least one applicator head 90, and also advantageously allowing the pigmented formulation stored within the reservoir 78 to remain well-mixed. A solenoid valve 100 may also be positioned in the return line 98 that may be closed during periods when the applicator supply system 70 is not operating, in order to prevent liquid within the distribution lines 92 from moving back into the reservoir 78 by gravitational action. Flow meters 102 operable to generate a signal when a liquid is in motion within the distribution lines 92 may be positioned near the at least one applicator head 90 in order to detect the absence of a liquid flow in the distribution lines 92.

Figure 5:
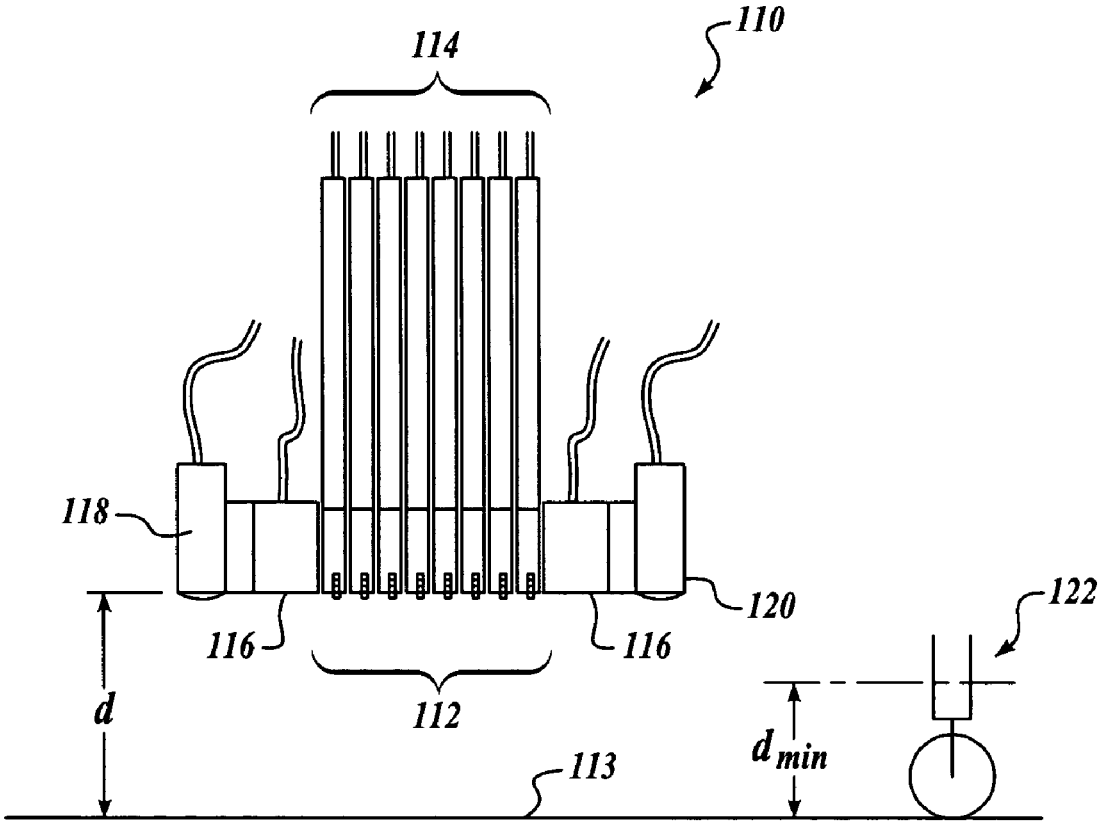
FIG. 5 is a plan view of an applicator head according to still another embodiment of the invention that may form a portion of the applicator of FIG. 2.

FIG. 5 is a plan view of an applicator head 110 according to still another embodiment of the invention that may form a portion of the applicator 32 of FIG. 2. The applicator head 110 includes a plurality of liquid jet heads 112 operable to emit droplets a pigmented ink or other like materials towards a surface 113 upon which an image is to be transferred. In some embodiments, each of the plurality of liquidjet heads 112 may be coupled to a separate applicator supply system 70 (FIG. 4) to dispense a selected color. For example, the applicator head 110 may be coupled to four separate applicator supply systems 70 to provide black, yellow, magenta and cyan-colored inks to the applicator head 110. The plurality of liquid jet heads 112 are also coupled to a plurality of activation lines 114 to transfer an activation signal from the controller 38 (as shown in FIG. 2) to a selected one of the liquid jet heads 112. The liquid jet heads 112 comprising the applicator head 110 are generally configured to deliver approximately 200 dots-per-inch resolution by generating droplets of the pigmented ink having a typical volume of approximately 80 pico-liters per droplet. One suitable applicator head is the commercially available XJ126 applicator head manufactured by Xaar PLC of Cambridge, UK, although other suitable applicator heads may also be used.

The applicator head 110 may also include at least one ultraviolet (UV) light source 116 positioned proximate to the liquid jet heads 112 and operable to project UV radiation towards the surface 113 in order to accelerate polymerization of a UV-cured ink. The UV light source 116 may also include a shutter mechanism to interrupt the emission of UV light from the source 116 so that the polymerization process may be interrupted. A proximity sensor 118 is coupled to the applicator head 110 that is operable to sense a distance 'd' between the applicator head 110 and the surface 113. Accordingly, the proximity sensor 118 may be comprised of an inductive proximity sensor, a capacitive proximity sensor, or an ultrasonic proximity sensor, all of which are available from the Allen-Bradley Co. of Milwaukee, Wis. The applicator head 110 may also include an optical detector 120 that is operable to view a portion of the surface 113 while an image is applied to the surface 113. The optical detector 120 may include an integral light source for illumination of the surface 113, such as a white light emitting diode (LED) or other similar light source. The applicator head 110 may also include a mechanical stop 122 to prevent the liquid jet heads 112 from contacting the surface 113. Accordingly, the mechanical stop 122 may include a spring that biases a wheel against the surface 113 and is further configured to prevent positioning the liquid jet heads 112 at a distance less than '$d_{min}$' from the surface 113.

Figure 6:
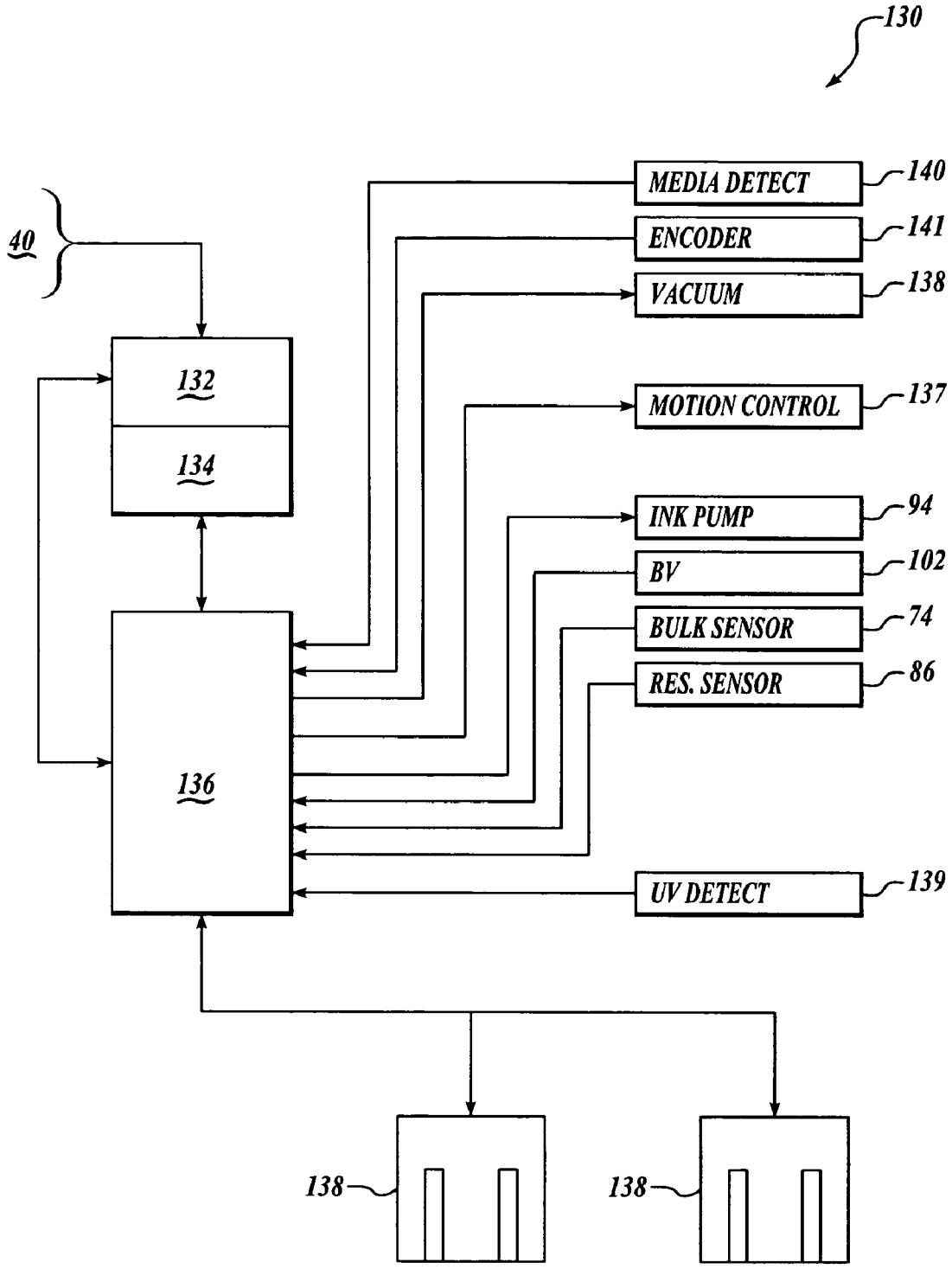
FIG. 6 is a block diagrammatic view of a controller according to still another embodiment of the invention that may be used with the system of FIG. 2.

FIG. 6 is a block diagrammatic view of a controller 130 according to still another embodiment of the invention that may be used with the system 30 of FIG. 2. The controller 130 includes a personal computing device 132 such as the Dimension XPS personal computer system available from Dell Inc. of Houston, Tex., although other suitable alternatives exist. The personal computing device 132 is configured to receive image information 40 through a communications line, such as a 100bT Ethernet communications line. The image information 40 may be formatted in the well-known tagged image file format (TIFF), or in other suitable formats, such as the standard bit-mapped graphics format (BMP) or PCX. The image information 40 may also include structural models, such as CATIA files that describe geometric details of an image surface. The personal computing device 132 is coupled to a peripheral component interconnect (PCI) board 134 to permit high speed digital communication between the personal computing device 132 and a printer interface unit 136. The printer interface unit 136 controls the applicator 32 (as shown in FIG. 2). For example, and with reference also to FIG. 4, the printer interface unit 136 is configured to accept signals generated by the level sensor 74, the level sensor 86 and the flow sensors 102 and to control the pump 94. The unit 136 is further configured to control the actuator (or other suitable motivating device) 36 (as shown in FIG. 2) by generating motion control commands 137 and vacuum system commands 138. The printer interface 136 is further coupled to a head interface board 138 that controls the functions of the applicator head 110 (as shown in FIG. 5). For example, a UV detect signal 139 is received by the head interface board 138 through the printer interface 136 to control the UV light source 116 (as shown in FIG. 5) and to control the shutter associated with the UV light source 116. The head interface board 138 may also be configured to receive a media detect signal 140 that indicates a surface is proximate to the applicator head 110. The head interface board 138 may also receive an encoder signal 141 that may be used to calculate a position corresponding to a next pixel to be printed. The media detect signal 140 and the encoder signal 141 are generated by the optical detector 120, which is coupled to the applicator head 110 (as shown in FIG. 5).

With reference still to FIG. 6, the operation of the controller 130 will be discussed in greater detail. The image information 40 includes an image file is created through the use of existing image software, such as Adobe Photoshop, available from Adobe Systems Inc. of San Jose, Calif., or CorelDRAW, available from Corel Corp. of Dallas Tex. The image file may be presented to the controller 130 in discrete parts, or "tiles", or it may be presented to the controller 130 as a single file that encompasses the entire image. The image information 40 may also include a three-dimensional surface model that describes the surface upon which the image is to be applied. The three-dimensional surface model may be generated by moving the applicator 32 across the surface and scanning the surface with the optical detector 120 and/or the proximity sensor 118 to compile a surface map of the aircraft portion that is to receive the image. Once a surface map is generated, it may be stored in the personal computing device 132 or it may be uploaded to a different storage location. Alternately, a pre-existing CATIA model that describes the structural details of a selected portion of the aircraft may be transferred to the controller 130 and used as a three-dimensional surface model. In another approach, a pre-existing surface model may be utilized as a general guide to the surface structure, with the optical detector 120 and/or the proximity sensor 118 scanning the surface to provide information regarding minor discrepancies in surface contour that may exist between the surface model and the aircraft in the as-built condition. The controller 130 controls the motion of the applicator 32 (as shown in FIG. 2) as it moves across the surface structure by transferring motion control commands 137 to the actuator 36 (also shown in FIG. 2). The commands 137 may impart three-dimensional motion to the actuator 36 so that the applicator 32 may move across curved surfaces that may include obstructions or other surface irregularities. The commands 137 may also impart motion to the actuator 36 so that the applicator 32 makes a single sweep across portions of the surface structure, so that the droplets forming an image on the surface structure are deposited in a single pass. Alternately, the motion imparted to the actuator 36 may include a plurality of repetitive sweeps across portions of the surface, in order to optically reinforce portions of the image having greater density.

Figure 7:
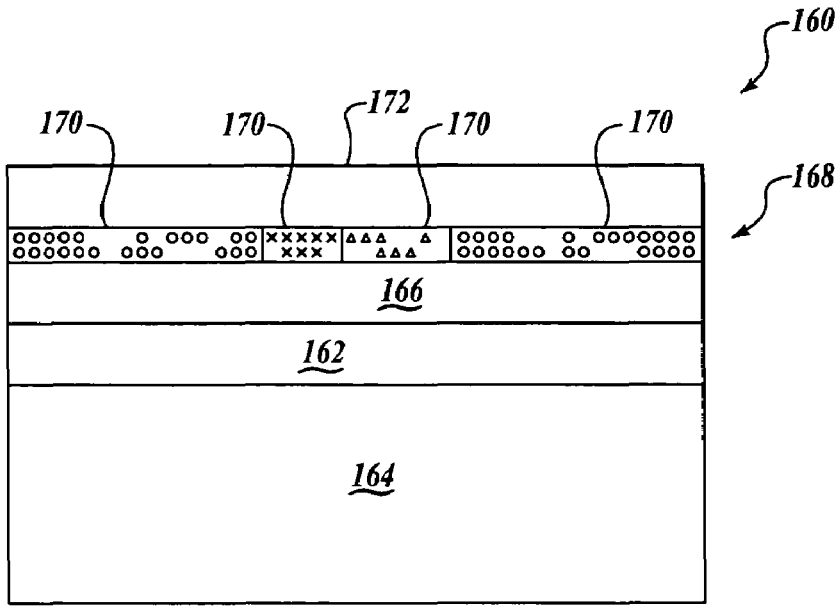
FIG. 7 is a partial cross-sectional view of an external portion of an aircraft that will be used to describe a method of applying an image to an aircraft according to another embodiment of the invention.

FIG. 7 is a partial cross-sectional view of an external portion 160 of an aircraft that will be used to describe a method of applying an image to an aircraft according to another embodiment of the invention. A primer layer 162 is applied to a supporting surface 164, which is typically a structural portion of the aircraft, such as a fuselage panel, a wing panel, or other external surfaces of the aircraft. The primer layer 162 may be comprised of zinc chromate pigments that are added to carriers of several different resin types, such as epoxy, polyurethane, alkyd and others. A white opaque base layer 166 comprised of a resin type that is compatible with the primer layer 162 is then applied. A graphics layer 168 may then be applied to the white opaque base layer 166 to form image segments 170, each comprised of a selected color and/or shape, which may be simultaneously applied to the white opaque base layer 166 using the ink-jet imaging process described in detail above. A transparent layer 172 may then be applied to the graphics layer 168 to protect the graphics layer 168 from the erosive effects of rain and water droplets encountered during flight, and to protect the image segments 170 of the graphics layer 168 from the prolonged effects of ultraviolet radiation.

Figure 8:
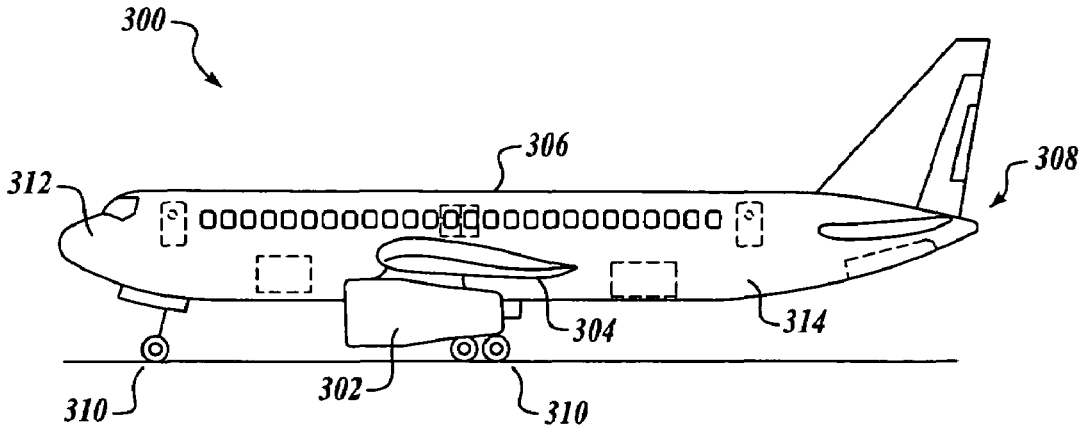
FIG. 8 is a side elevation view of an aircraft having at least one graphic image according to an embodiment of the invention.

Those skilled in the art will also readily recognize that the foregoing embodiment may be applied to a wide variety of different locations on an aircraft. Referring now in particular to FIG. 8, a side elevation view of an aircraft 300 having at least one graphic image 314 according to the foregoing embodiment is shown. With the exception of the graphic image 314, the aircraft 300 includes components and subsystems generally known in the pertinent art, and in the interest of brevity, will not be described further. The aircraft 300 generally includes one or more propulsion units 302 that are coupled to wing assemblies 304, or alternately, to a fuselage 306 or even other portions of the aircraft 300. Additionally, the aircraft 300 also includes a tail assembly 308 and a landing assembly 310 coupled to the fuselage 306. The aircraft 300 further includes other systems and subsystems generally required for the proper operation of the aircraft 300. For example, the aircraft 300 includes a flight control system 312 (not shown in FIG. 8), as well as a plurality of other electrical, mechanical and electromechanical systems that cooperatively perform a variety of tasks necessary for the operation of the aircraft 300. Accordingly, the aircraft 300 is generally representative of a commercial passenger aircraft, which may include, for example, the 737, 747, 757, 767 and 777 commercial passenger aircraft available from The Boeing Company of Chicago, Ill. Although the aircraft 300 shown in FIG. 8 generally shows a commercial passenger aircraft, it is understood that the graphic image 314 according to the foregoing embodiment may also be applied to flight vehicles of other types. Examples of such flight vehicles may include manned or even unmanned military aircraft, rotary wing aircraft, or even ballistic flight vehicles, as illustrated more fully in various descriptive volumes, such as Jane's All The World's Aircraft, available from Jane's Information Group, Ltd. of Coulsdon, Surrey, UK.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A system for applying a graphic image to a surface, comprising:

an applicator configured to direct a droplet pattern of a pigmented ink of at least one color towards the surface;

an motivating device coupled to the applicator that is operable to move the applicator in at least one transverse direction relative to the surface and also in a direction perpendicular to the surface, wherein the motivating device comprises at least one vacuum retainer configured to hold the motivating device in proper registration with the surface; and a controller coupled to the motivating device that is configured to receive data corresponding to the graphics image and to control at least the motion of the motivating device to apply the graphic image to the surface.

2. The system of claim 1, wherein the controller is further coupled to the applicator to control the droplet pattern.

3. The system of claim 1, wherein the applicator further comprises at least one applicator head having a plurality of liquid jet heads.

4. The system of claim 1, wherein the applicator further comprises at least one ultraviolet light source operable to polymerize an ultraviolet (UV) cured ink.

5. The system of claim 1, wherein the applicator further comprises an optical detector operable to generate an optical image of a portion of the surface.

6. The system of claim 1, wherein the applicator further comprises a proximity detector operable to determine a distance between the applicator and the surface.

7. The system of claim 1, wherein the applicator further comprises a mechanical stop that extends to the surface to restrict movement of the applicator towards the surface.

8. The system of claim 1, wherein the motivating device further comprises a robotic device configured to move about at least three-axes.

9. The system of claim 1, wherein the motivating device further comprises a first frame and a second frame coupled to the first frame, the second frame being spaced apart from the first frame to accommodate the surface therebetween.

10. The system of claim 9, wherein the motivating device further comprises guides oriented in a transverse direction relative to the surface, and at least one translation device operable to move the applicator along the guides.

11. The system of claim 10, wherein the motivating device further comprises a translation device operable to move the applicator in a perpendicular direction relative to the surface.

12. The system of claim 1, further comprising an applicator supply system having at least one reservoir that is fluidly coupled to the applicator and configured to transfer the ink from at least one reservoir to the applicator.

13. The system of claim 12, wherein the at least one reservoir further comprises a bulk supply reservoir that is fluidly coupled to a feeder reservoir that is operable to transfer ink to the applicator.

14. The system of claim 13, wherein the bulk supply reservoir is positioned at a first elevation and the feeder reservoir is positioned at a second elevation greater that the first elevation, further wherein the bulk supply reservoir and the feeder reservoir are fluidly coupled through a pump operable to transfer ink from the bulk supply reservoir to the feeder reservoir.

15. The system of claim 1, wherein the controller further comprises printer interface unit operable to exchange control signals with the motivating device and the applicator.

16. The system of claim 15, wherein the controller further comprises a personal computing device operable to receive image information from an image source and transfer the image information to the printer interface unit.

17. The system of claim 16, wherein the image information is formatted in one of a tagged image file (TIFF) and a bit-mapped image format (BMP).

* * * * *